US005199130A

United States Patent [19]

Lazar

[11] Patent Number: 5,199,130

[45] Date of Patent: Apr. 6, 1993

[54] HYDROPHOBIC MOP WHICH RETAINS ITS SHAPE

[76] Inventor: Johanna D. Lazar, 117 E. 57th St., New York, N.Y. 10022

[21] Appl. No.: 824,507

[22] Filed: Jan. 23, 1992

Related U.S. Application Data

[63] Continuation-in-part of Ser. No. 656,018, Feb. 15, 1991, abandoned, which is a continuation of Ser. No. 208,734, Jun. 17, 1988, abandoned.

[51] Int. Cl.[5] ..... A47L 13/20

[52] U.S. Cl. ..... 15/229.2; 15/147.1; 15/226; 15/229.1

[58] Field of Search ..... 15/151, 228, 229.1, 15/229.6, 225, 226, 223, 229.2, 209.1, 229.11, 147.1, 147.2

[56] References Cited

U.S. PATENT DOCUMENTS

| | | | |
|---|---|---|---|
| 957,025 | 5/1910 | Zachry | 15/229.2 |
| 963,566 | 7/1910 | Huff | 15/147 R |
| 1,462,794 | 7/1923 | Kumpunen | 15/228 |
| 2,320,372 | 6/1943 | McCarthy . | |
| 2,729,841 | 1/1956 | Littleton | 15/229.2 |
| 2,905,958 | 9/1959 | Sannes | 15/229.2 |
| 3,195,160 | 7/1965 | Amsen . | |
| 3,204,277 | 9/1965 | Visman et al. | 15/223 |
| 3,336,618 | 8/1967 | Day | 15/209 B |
| 3,343,196 | 9/1967 | Barnhouse . | |
| 3,434,177 | 3/1969 | Parry | 15/223 |
| 3,593,359 | 7/1971 | Strauss . | |
| 3,663,981 | 5/1972 | DuCrest et al. | 15/228 |
| 3,748,682 | 7/1973 | Rhodes . | |
| 3,772,728 | 11/1973 | Johnson . | |
| 3,877,105 | 4/1975 | Breland | 15/209 B |
| 3,924,288 | 12/1975 | Breland | 15/209 B |
| 4,114,224 | 9/1978 | Disko | 15/229.2 |
| 4,168,863 | 9/1979 | Hatcher . | |
| 4,190,921 | 3/1980 | Rose | 15/209 B |
| 4,199,835 | 4/1980 | Heyer et al. | 15/209 B |
| 4,288,884 | 9/1981 | Bahls . | |

FOREIGN PATENT DOCUMENTS

| | | | |
|---|---|---|---|
| 2827909 | 1/1980 | Fed. Rep. of Germany . | |
| 1085736 | 7/1954 | France . | |
| 2403773 | 5/1979 | France | 15/229.1 |
| 122891 | 2/1919 | United Kingdom | 15/229.1 |

*Primary Examiner*—Harvey C. Hornsby
*Assistant Examiner*—Mark Spisich
*Attorney, Agent, or Firm*—Darby & Darby

[57] ABSTRACT

A mop having a plurality of cleaning elements each made of a hydrophobic net material with a center area having a respective locating aperture in alignment with each other. The center area of each is compressed between a securing member and fastener head. The fastener has a stem which is inserted through the locating apertures and held by the securing member. The cleaning elements tangle and engage with each other because of the compression and because edges of each of the cleaning elements is formed of protruding ends of yarns of the net material which engage within interstices of neighboring ones of the cleaning elements. The protruding ends at the free ends of the cleaning elements as well as both sides of the cleaning elements constitute abrasive surfaces which clean external surfaces of particulate matter when moved back and forth against the external surfaces.

8 Claims, 3 Drawing Sheets

HYDROPHOBIC MOP WHICH RETAINS ITS SHAPE

CROSS-REFERENCE TO COPENDING APPLICATIONS

This is a continuation-in-part of U.S. Ser. No. 07/656,018 filed Feb. 15, 1991, now abandoned, which is in turn a continuation of U.S. Ser. No. 07/208,734 filed Jun. 17, 1988, now abandoned

BACKGROUND OF THE INVENTION

The present invention relates to a hydrophobic mop which retains its shape.

Unlike hydrophilic mops, hydrophobic mops will not absorb water and may be shaken to remove retained water. Hydrophilic mops have a tendency to droop and flop about when they get wet in use and must be wrung out.

Cleaning bathtubs, shower stalls, and the like has been problematic because of the necessity to bend in order to scrub the tub clean with a scrub brush. It would be desirable to provide a mop, whose head was made of an abrasive material, to scrub such tubs clean while the user remains in a standing position. It would be further desirable if such a mop did not require wringing out so as to speed up cleaning time. Further, it would be desirable to provide a mop head which did not retain odors from surfaces being cleaned.

U.S. Ser. No. 07/208,734, whose subject matter is incorporated herein by reference, discloses a hydrophobic mop. Since the filing of Ser. No. 07/208,734, the mop has undergone some further development.

SUMMARY OF THE INVENTION

The present invention is directed to a mop which comprises a handle, a mop head and a fastener, all of which being secured together. The mop head includes a plurality of elongated cleaning element strips each having a center area with a locating aperture in alignment with each other. Each cleaning element strip is comprised of a strip of net mesh material composed of hydrophobic yarns arranged to define interstices. Each strip has jagged edges comprised of protruding ends of the yarns. The fastener extends through all of the locating apertures and is secured to the handle. The center area of each of the cleaning elements is compressed.

The shape of the mop head is generally spherical and is retained by the random entanglement of the jagged edges of the cleaning element strips within the interstices of neighboring ones of the other cleaning element strips. Each strip has two sides, each being a substantially flat surface between two free ends. Both the flat surfaces of the strips and the jagged edges of the free ends of the strips serve as abrasive surfaces. These abrasive surfaces are suitable for cleaning external surfaces of particulate matter when moved back and forth against external surfaces to be cleaned.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
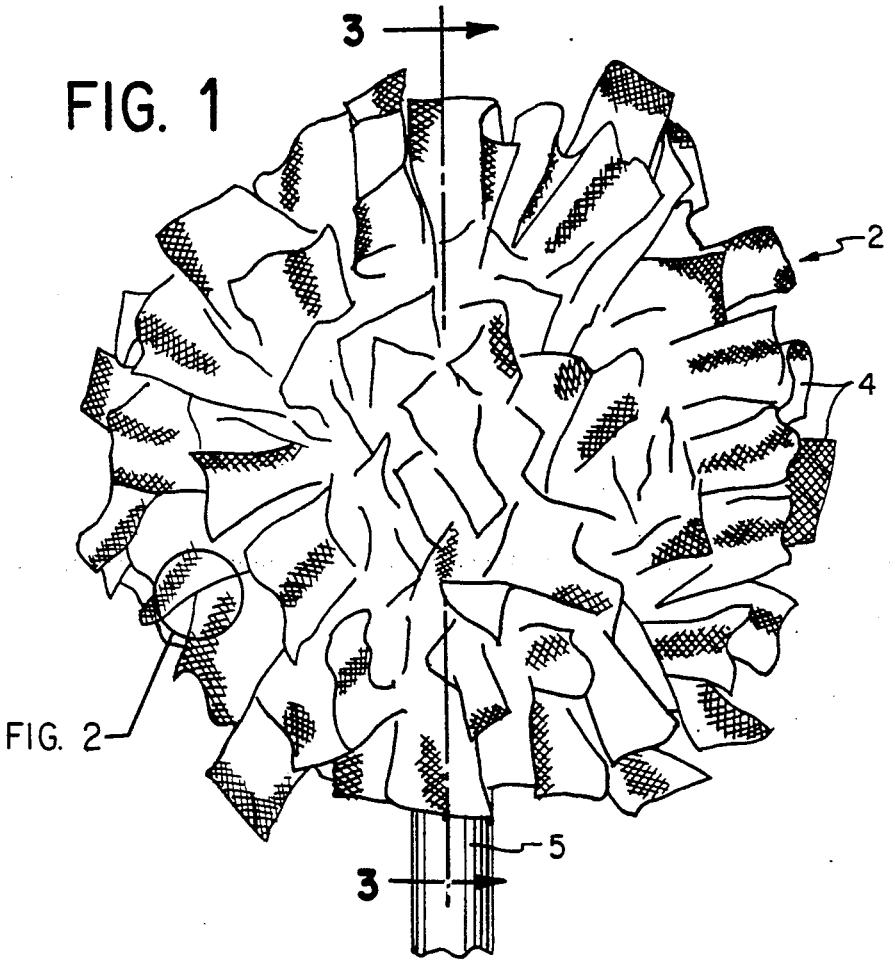
FIG. 1 is an elevational view of the mop in accordance with the invention.
Figure 2:
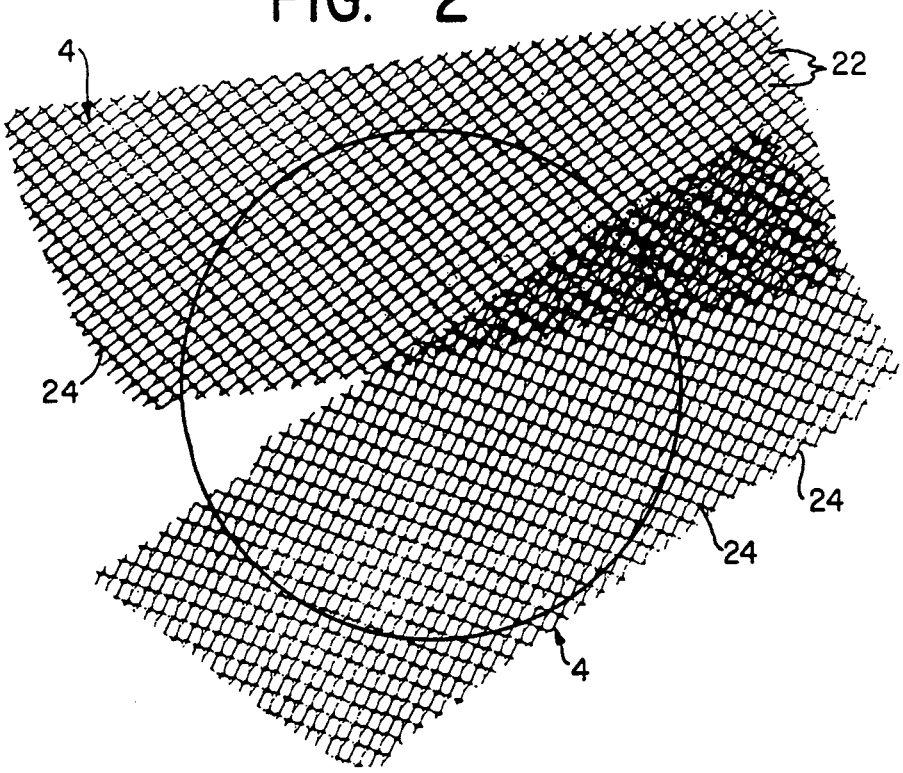
FIG. 2 is an enlargement of the circled area in FIG. 1.
Figure 3:
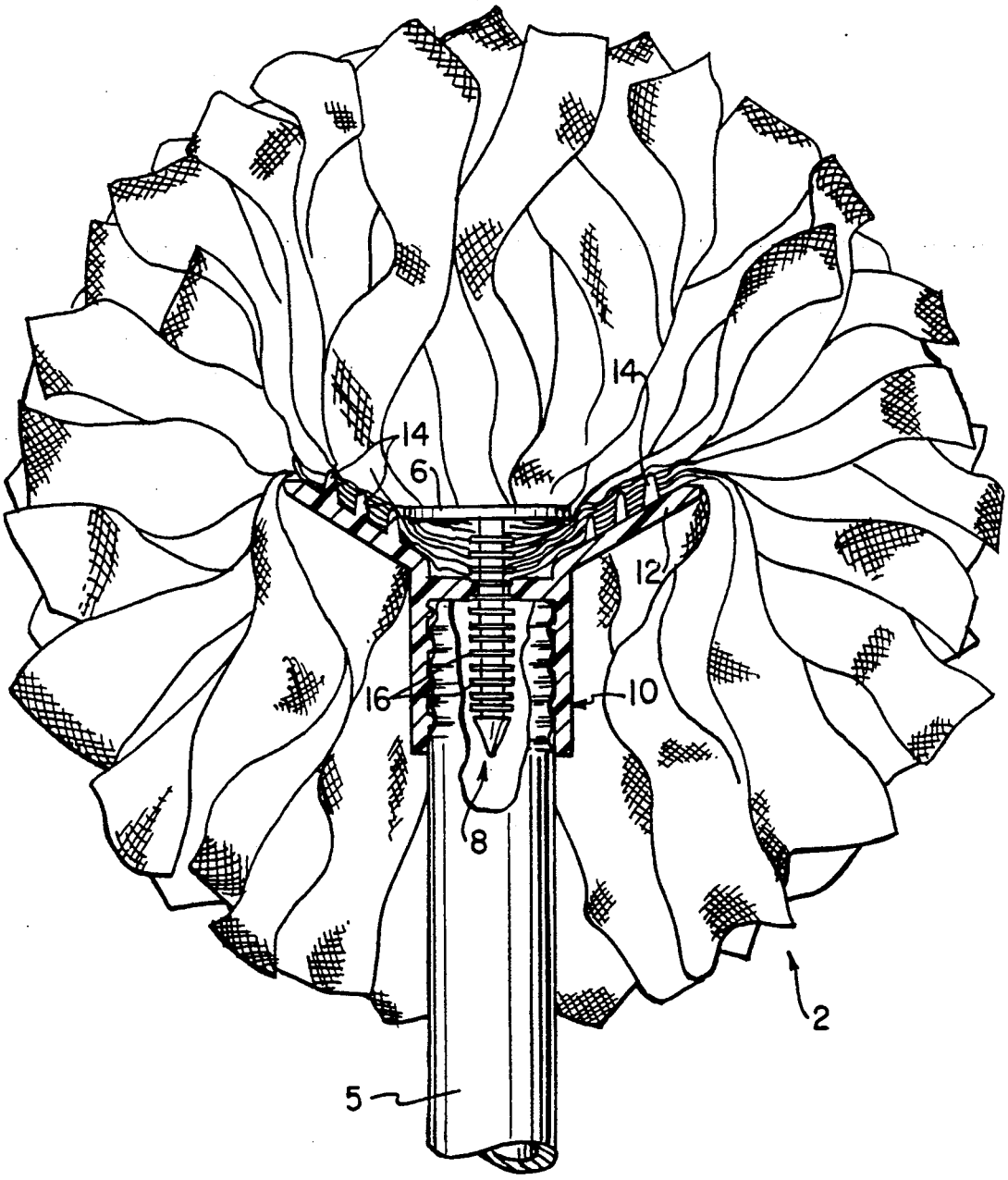
FIG. 3 is a cross-section taken across section lines 3—3 of FIG. 1.

FIG. 1 shows the mop in its final form. The mop head 2 consists of a plurality of elongated cleaning elements or strips 4 of hydrophobic net material which take on a fluffy, generally full-bodied shape of spherical dimension. A handle 5 extends from the mop head and is preferably sturdy, made from a non-corrosive metal or wood and is long enough to allow a user to stand while cleaning a bathtub. FIG. 2 shows the engagement of two cleaning elements with each other. Referring to FIG. 3, the center area of the strips are squeezed between a head 6 of a fastener 8 and a cup-shaped receptacle 10.

Figure 4:
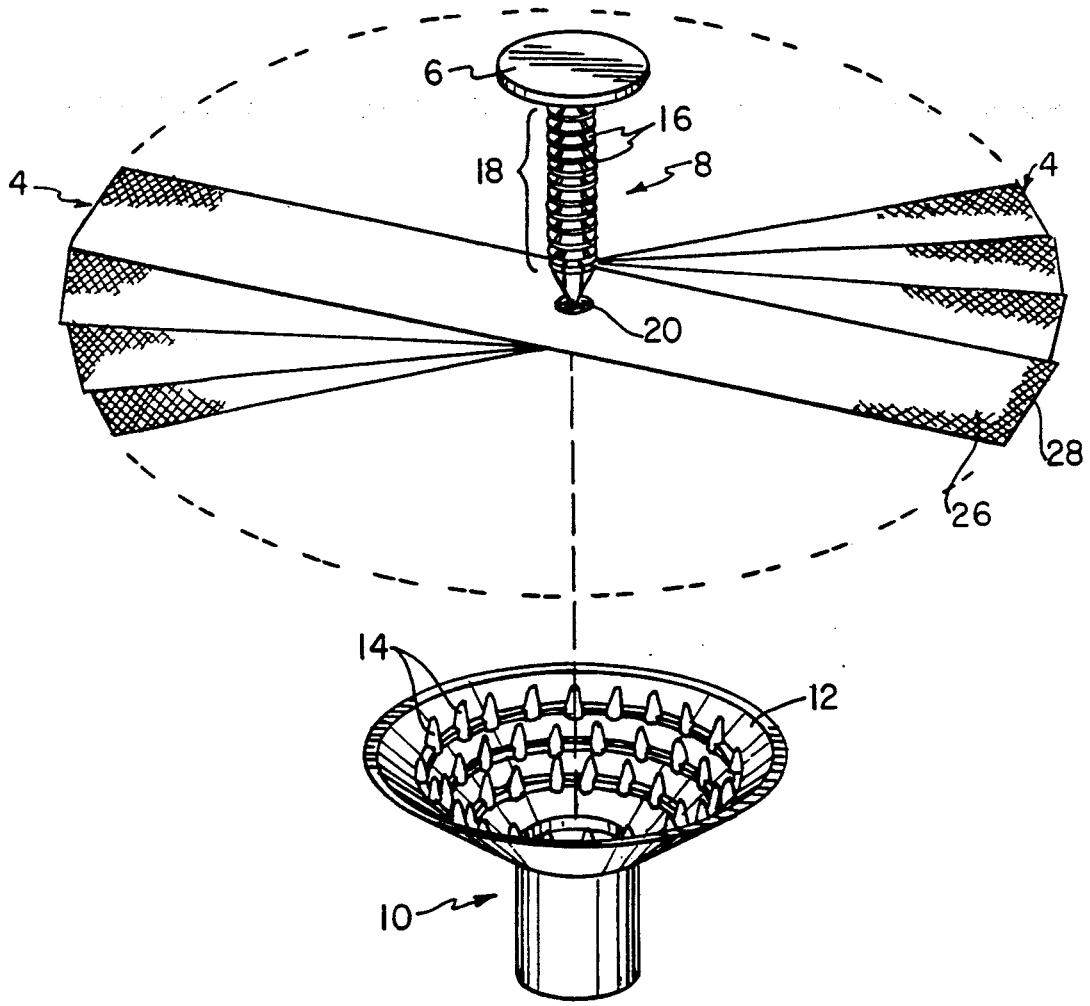
FIG. 4 is a perspective exploded view of FIG. 3 prior to assembly.

FIGS. 3 and 4 show that the cup-shaped receptacle 10 has a concave face 12 on which may be a plurality of antirotation pins 14 which are spaced radially and circumferentially apart, which prevent relative rotation of the strips. The fastener 8 preferably is a press-fit fastener, such as a known Christmas tree type connector, which has a plurality of radially extending deformable fingers 16 spaced apart from each other along the length of the stem 18 of the fastener. The fastener 8 could also be thread-fit, but if so should remain secured without being able to unthread. The receptacle 10 is a known modified bell type, which is to have a hole punched through its center. The stem 18 of the fastener 8 is inserted into the hole, causing the fingers to deform for retaining the fastener and receptacle together. Thus, the diameter of the hole is slightly smaller than diameter of the fastener with its fingers in an unexpanded state.

The stem 18 of the fastener 8 is inserted through each of the aligned locating apertures 20 in the strips 4. The modified bell type receptacle may be procured from various suppliers, such as Molding Industries of America, Inc. of New York, Injection Corporation of New Jersey, or Pacer Tool and Plastic of New Jersey. The Christmas tree type connector may be procured from various suppliers.

The cleaning elements are made of hydrophobic, woven netting, cut on a bias to the warp, so that the cut edges reveal small protruding ends of the fibers which make the edges "jagged". This netting is a net tulle mesh made of polypropylene, dacron, polyester or nylon or any combination thereof. The netting retains its stiffness even when wet. This denier and hand of the material is selected for its stiffness, strength and durability to withstand the rigors of the scrubbing action. Preferably the denier is 20 to 70.

The net tulle mesh material is normally used for crinoline, i.e., an open weave fabric of horse hair or nylon which is usually stiffened. A characteristic of the net tulle mesh material is its ability to expand by manual pulling in a direction of the diagonals through the juxtaposed interstices 22 of the mesh. When released, the material resiliently returns to its unexpanded state. However, it is more difficult, if not impossible to expand the mesh material by pulling along the direction of elongation of the threads or yarns which comprise the mesh. Each strip is cut from a roll of net tulle mesh such that the diagonals of the interstices 20 of the mesh align parallel to the length of the strip. This allows the strip to be expanded in the direction of its length or even transversely since there will also be diagonals aligned in that direction.

A surprising characteristic of the invention is that when a circular stack of overlapped strips of net mesh material are secured together at their centers, they entangle with each other such that their jagged edges, which are comprised of protruding ends 24 of hydrophobic yarns as shown in FIG. 2, engage neighboring ones of other cleaning elements in contact with them. This keeps the cleaning strips retained to each other. In sense, the strips engage each other in a manner similar to engaging hooks and loops.

The preferred method of manufacture is as follows. A fastener is held at the center of a turntable with its stem pointing upward. The turntable is rotated and one or two strips at a time are carefully fed onto the turntable to overlap each other in succession along their entire lengths and yet minimize entanglement, the hole at the center of each strip encircling the stem of the fastener. Eventually, a circle is filled out as shown in FIG. 4 to form a fan-like stack of strips. The number of layers of strips used in this initial stack formation process depends upon how dense the mop is to be; preferably, there are 17–18 full circular layers to give the mop head a desired fluffiness and bulk.

Next, a press may be used to force the cup-like receptacle 10 onto the stem of the fastener 8, thereby squeezing the strips at their centers. The head 8 of the fastener is held in place by a recess in the base while the press is lowered. The fingers 16 on the stem 18 deform in succession during insertion into the receptacle. The assembled mop is removed from the turntable and the strips entangle with each other as shown in FIG. 2 by engagement of the protruding ends of the hydrophobic yarns along the lengths of the strips within interstices in the mesh of the other strips (not just the immediately adjacent cleaning elements) in a random way "fluffing up" the resulting assembly as shown in FIG. 1. As a result, the mop head takes on a fluffy, generally full-bodied shape of spherical dimension.

The bias-cut netting is capable of stretching and twisting along its length and width. As the result of the jagged edges and bias-cut stretch and twist, the cleaning elements become permanently entangled in this fluffy, generally full-bodied shape of spherical dimension. The entangled cleaning elements hold the spherical shape regardless of the direction of gravity and as a practical matter cannot be untangled and straightened out again.

In use, the mop head will not scratch the external surface of fiberglass tubs and will not flop around as do hydrophilic mops that retain water. Instead, the mop head has tendency to resiliently retain its shape and its cleaning elements do not flatten out. A bathtub, shower stall, or the like becomes cleaned of particulate matter by back and forth motion of the mop head against the external surfaces of the tub or shower stall. The flat surfaces 26 and protruding ends 24 of the yarns at the free end 28 of the strips 4 (see FIGS. 2 and 4) serve as abrasive surfaces to help clean the external surfaces of the bathtub during the back and forth motion. When the cleaning is done, the mop head resiliently returns to its fluffy, generally full-bodied shape of spherical dimension.

The closer the protruding ends 20 of the hydrophobic yarns are to the center of the cleaning strips 4, the closer the cleaning strips are to each other and therefore the greater the entanglement. The overall shape of the mop is set by the entanglement of the protruding ends 20 within interstices 22 of the cleaning elements.

Most of the spherical outline of the resulting tangle of cleaning elements consists of voids or air spaces, because the jagged edges of the cleaning elements interlock with the mesh of other cleaning elements. Thus, the mop head is somewhat airy, because of the voids or air spaces.

The fluffy spherical shape, jagged edges, and voids within the assembly have the following advantages, among others:

They cushion the center pin from touching the surface to be cleaned and provide a pleasant "bouncy" feel when pressed to the surface to be cleaned. They conform to the (generally convex) curves of the surface to be cleaned and present the abrasive surfaces, that is, the jagged edges and two sides of the cleaning elements to the surface to be cleaned. They enhance water capture by the hydrophobic netting and facilitate removal of water from the mop head by shaking or spinning on the axis of the handle, and facilitate air-drying, because of the voids or air spaces created by the interlocked strips. They result in an attractive bouffant or "Orphan Annie" appearance (when the cleaning elements are dyed or colored red).

The interstices are also useful in trapping and distributing throughout the mop any abrasive cleanser which may be used, such as liquid scrub cleaners. The cleansers rinse right out via the interstices and air spaces and the mop head dries quickly. The mop head does not retain odors because it does not absorb liquids, but rather may be rinsed clean.

While the foregoing description and drawings represent the preferred embodiments of the present invention, it will be understood that various changes and modifications may be made without departing from the spirit and scope of the present invention.

What is claimed is:

1. A mop for cleaning external surfaces; comprising:

a handle;

a mop head which includes a plurality of elongated cleaning elements each having a center area with a locating aperture in alignment with each other, the cleaning elements each being comprised of net mesh material composed of hydrophobic yarns which define interstices, each of the cleaning elements having two sides facing away from each other and having edges;

a fastener extending through each of the locating apertures;

means for securing the handle and the fastener together;

means for compressing the center area of each of the cleaning elements together; and means for retaining the shape of the mop head, the retaining means including a plurality of protruding ends of the hydrophobic yarns which comprise the edges of the cleaning elements and which engage within interstices of the net mesh material of neighboring ones of the cleaning elements, the cleaning elements cooperating with each other in response to the compressing means and the retaining means to cause the mop head to have and resiliently retain a fluffy, full-bodied shape of generally spherical dimension, the cleaning elements having free ends whose edges are comprised of a plurality of the protruding ends, the edges of the free ends of the cleaning elements and the two sides of the cleaning elements constituting abrasive surfaces which are suited for cleaning the external surfaces of particulate matter when moved back and forth against the external surfaces.

2. A mop as in claim 1, wherein the compressing means includes a cup-shaped portion which opens facing the cleaning elements.

3. A mop as in claim 1, wherein the mop head includes a plurality of layers of cleaning elements, each of the layers including a respective group of cleaning elements overlapping each other along their lengths so as to define a circular area.

4. A mop as in claim 3, wherein the plurality of layers includes at least 17 layers.

5. A mop as in claim 1, wherein the mop head has a bouffant, generally spherical appearance.

6. A mop as in claim 1, wherein the retaining means and compressing means cooperate to cause random ones of the cleaning elements that are within contact to engage each other.

7. A mop as in claim 1, wherein a frequency of entanglement of the protruding ends in interstices of other cleaning elements is greater the closer the protruding ends are to the center area.

8. A mop as in claim 7, wherein the entanglement is such that water may be retained by the mop head at the entanglement, the cleaning elements being arranged so that when the mop head is shaken, the retained water leaves the mop head as a result of the mop head being fluffy and thereby airy.

* * * * *